United States Patent [19]

Nishikawa

[11] Patent Number: 4,935,593

[45] Date of Patent: Jun. 19, 1990

[54] CABINET FOR COOKING APPLIANCES

[76] Inventor: Kazuhiro Nishikawa, Nogoya Works, Kabushiki Kaisha Toshiba 21, Yoshihara-cho 4-chome, Nishi-ku Nagoya, Japan

[21] Appl. No.: 432,031

[22] Filed: Nov. 6, 1989

[30] Foreign Application Priority Data

Nov. 29, 1988 [JP] Japan ..... 63-301522

[51] Int. Cl.[5] ..... H05B 6/64; F24C 15/08

[52] U.S. Cl. ..... 219/10.55 R; 219/10.55 E; 219/10.55 D; 312/236; 312/242; 126/273 A; 126/275 E

[58] Field of Search ..... 219/10.55 R, 10.55 E, 219/10.55 D, 402, 403; 312/236, 242, 245, 246; 126/19 M, 19 R, 273 A, 273 R, 275 E, 275 R

[56] References Cited

U.S. PATENT DOCUMENTS

| | | | |
|---|---|---|---|
| 2,921,576 | 1/1960 | Nolan | 312/242 X |
| 3,004,815 | 10/1961 | O'Kain et al. | 312/242 |
| 4,051,837 | 10/1977 | Norman | 126/275 R |
| 4,282,416 | 8/1981 | White | 219/10.55 R |
| 4,348,068 | 9/1982 | Hawkins et al. | 312/236 X |
| 4,609,801 | 9/1986 | Spencer et al. | 219/10.55 R |

FOREIGN PATENT DOCUMENTS 58-18036 2/1983 Japan .

*Primary Examiner*—Philip H. Leung
*Attorney, Agent, or Firm*—Philip M. Shaw, Jr.

[57] ABSTRACT

A cabinet for containing cooking appliances such as a microwave oven having a cooking chamber having a front opening, a door for closing the front opening of the cooking chamber, a locking mechanism for locking the door at a closed position, and a manually operated member mounted in the vicinity of the front opening of the microwave oven for manually unlocking the door locked by the locking mechanism is disclosed. The cabinet includes a compartment for containing the cooking appliance, a cover for concealing a space between the front inner periphery of the compartment and the front outer periphery of the cooking appliance, the cover having a recess formed therein so as to correspond to the manually operated member so that the manually operated member is positioned in the recess, the recess having a front opening, and a closure member rotatably mounted on the cover member so as to close and open the front opening of the recess.

6 Claims, 4 Drawing Sheets

CABINET FOR COOKING APPLIANCES

BACKGROUND OF THE INVENTION

This invention relates to a cabinet having one or more compartments for containing cooking appliances such as a high frequency heating apparatus, and more particularly to such a cabinet having a construction that a cover is attached to the front thereof so as to cover a space between the front outer periphery of the cooking appliance and inner periphery of the compartment of the cabinet.

As disclosed in Japanese Published Patent Application No. 59-8724, a cooking appliance, for example, a high frequency heating apparatus is provided with a key switch on an operation panel so that the key switch is operated to electromechanically open a door of a cooking chamber. In such a high frequency heating apparatus as described above, the door cannot be opened unless the apparatus is energized. Accordingly, food or foodstuff cannot be taken out of the cooking chamber when the failure of electric power supply occurs during the cooking operation.

To solve the above-described problem, the inventor previously applied for a patent on an invention in U.S.A., which application has been assigned Ser. No. 298,984 and is pending. This application discloses a high frequency heating apparatus including means for mechanically unlocking the door from the outside as well as the means for electromechanically unlocking the door. The mechanical unlocking means includes a manually operated member positioned at the underside of the door.

On the other hand, a cabinet for containing a plurality of cooking appliances or a cooking appliance such as a high frequency heating apparatus together with other cooking utensils has been commercially produced. When the high frequency heating apparatus is put into one of compartments of such a cabinet, a space between the high frequency heating apparatus and the compartment occasionally defiles the appearance of the cabinet. For this reason, a framelike front cover is provided on the front of the compartment so as to cover the front outer periphery of the high frequency heating apparatus, thereby concealing the space from view.

When the high frequency heating apparatus having both electromechanically and mechanically door unlocking means is contained in the compartment of the cabinet having such a front cover as described above, the manually operated member provided at the underside of the cooking chamber door is covered by the cover member. Consequently, the door cannot be opened in the occurrence of failure of electric power supply unless the cover is detached from the cabinet.

SUMMARY OF THE INVENTION

Therefore, an object of the present invention is to provide an improved cabinet for cooking appliances wherein the mechanical operation for unlocking the door of the cooking chamber can be performed without detachment of the cover when the cooking appliance is contained in a compartment of the cabinet with the cover covering the space between the cooking appliance and the compartment.

A cabinet in accordance with the present invention is suitable for containing a cooking appliance including a cooking chamber having a front opening, a door for closing the front opening of the cooking chamber, a locking mechanism for locking the door at a closed position, and a manually operated member provided in the vicinity of the front opening of the cooking appliance for manually unlocking the door locked by the locking mechanism. The cabinet comprises a compartment for containing the cooking appliance, a cover provided for concealing a space between the front inner periphery of the compartment and the front outer periphery of the cooking appliance, the cover having a recessed portion formed therein so as to correspond to the manually operated member so that the manually operated member is positioned in the recessed portion, the recessed portion having a front opening, and a closure member rotatably mounted on the cover member so as to close and open the front opening of the recessed portion.

In the case of manually unlocking the door of the cooking appliance, the closure member is pressed, for example, with fingers so as to be rotatably moved, thereby operating the manually operated member.

Other objects of the present invention will become obvious upon an understanding of the illustrative embodiment about to be described or will be indicated in the appended claims, and various advantages not referred to herein will occur to one skilled in the art upon employment of the invention in practice.

DESCRIPTION OF THE PREFERRED EMBODIMENT

An embodiment wherein the present invention is applied to a cabinet for containing a high frequency heating apparatus will now be described with reference to the accompanying drawings.

Figure 1:
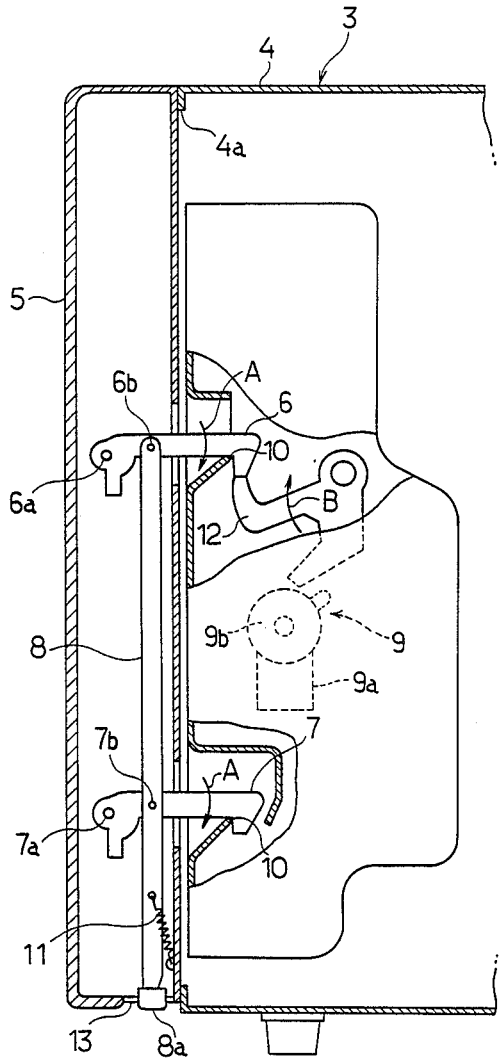
FIG. 1 is an enlarged longitudinal section of a door locking mechanism of a high frequency heating apparatus to be contained in a cabinet in accordance with the invention.
Figure 2:
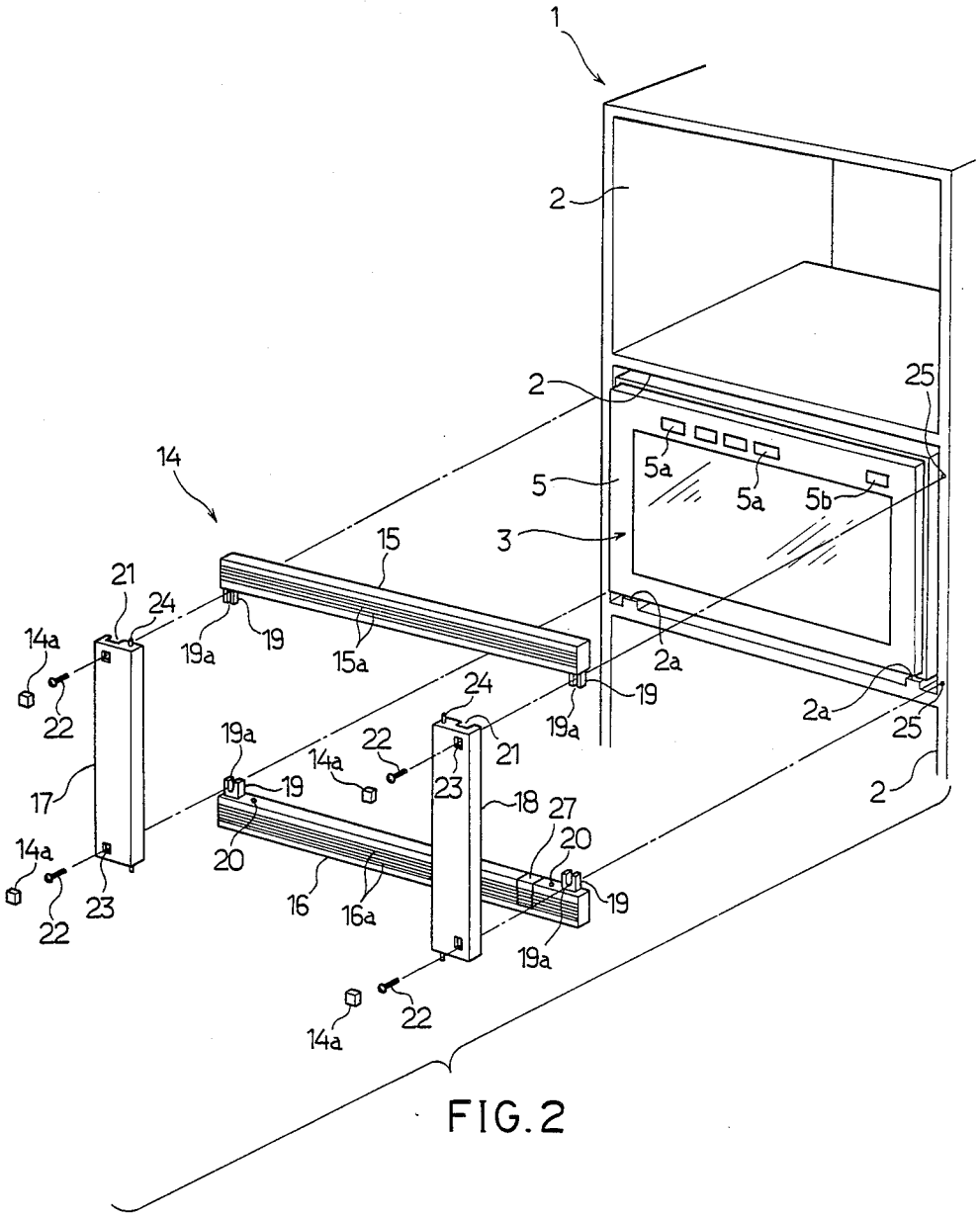
FIG. 2 is an exploded perspective view of part of the cabinet relating to the invention.

FIG. 2 illustrates a cabinet 1 for cooking appliances in accordance with the invention. The interior of cabinet 1 is divided into a plurality of compartments 2. A high frequency heating apparatus 3 of the general construction having a magnetron (not shown) as a high frequency wave source is contained in one of compartments 2 of cabinet 1. A casing 4 of high frequency heating apparatus 3 has a cooking chamber (not shown) having a front opening 4*a* which is closed by a door 5, as shown in FIG. 1. Key switches 5*a* for setting various cooking conditions and a door opening key switch 5*b* of the touch operation type are provided on the front upper portion of door 5 in the same manner as in the prior art. Hooks 6 and 7 are rotatably mounted on respective shafts 6*a* and 7*a* at the inside of door 5. Both hooks 6 and 7 are connected to a rod 8 by pins 6*b* and 7*b*, respectively. In the condition that front opening 4*a* of the cooking chamber is closed by door 5, hooks 6 and 7 are engaged with respective engagement openings 10 formed in the front portion of casing 4, thereby locking door 5 at the closed position. A tension coil spring 11 is provided between rod 8 and door 5 for rotatively urging hooks 6 and 7 in the direction of arrow A through rod 8, thereby holding door 5 in the locked position.

Door 5 locked by way of hooks 6 and 7 may be unlocked both electromechanically and manually. In the case of electromechanically unlocking door 5, a motor 9*a* of an electromechanical unlocking device 9 is energized when door opening key switch 5*b* is operated, thereby rotatably moving a cam mechanism 5*b*. Rotatable movement of cam mechanism 5*b* causes a push lever 12 to rotatably move in the direction of arrow B, thereby unlocking door 5. More specifically, rotatable movement of push lever 12 pushes upper hook 6 upwardly such that hook 6 is rotatably moved in the direction opposite arrow A. As the result of such upward movement of upper hook 6, lower hook 7 is lifted up with the movement of rod 8. Consequently, both hooks 6 and 7 are rotatably moved in the direction opposite to arrow A to thereby disengage from respective engagement openings 10. Since the electromechanical unlocking device is disclosed in detail in U.S. patent application Ser. No. 298,984, unlocking device 9 will not further described. In manually unlocking door 5, a force is applied to rod 8 to directly lift up the same. The lower end of rod 8 is extended to the underside of door 5 and a push button 8*a* serving as a manually operated member is secured to the lower end of rod 8. Push button 8*a* is inserted into an aperture 13 formed in the underside of door 5 so as to be operated with a finger or the like from the outside. When push button 8*a* is pushed with the finger or the like, rod 8 is lifted up such that both hooks 6 and 7 are rotatably moved in the direction opposite to arrow A, thereby unlocking door 5 in the same manner as described above.

Referring to FIG. 2, two projections 2*a* formed on the bottom wall of compartment 2 of cabinet 1 extends from the front to the rear thereof. High frequency heating apparatus 3 is placed on the projections 2*a* when contained in compartment 2. In the condition that high frequency heating apparatus 3 is contained in one of compartments 2, door 5 thereof is positioned at the outside of compartment 2. A cover 14 is provided along the front inner periphery of compartment 2 so as to cover the outer periphery of high frequency heating apparatus 3, which cover 14 will be described in detail. As shown in FIG. 2, cover 14 comprises upper and lower cover members 15 and 16 and right and left cover members 17 and 18 coupled with members 15 and 16. In order that these cover members are combined with one another, coupling projections 19 are integrally formed on the right-hand and left-hand sides of each of upper and lower cover members 15 and 16. Each coupling projection 19 has a generally U-shaped groove 19*a* formed therein. Engagement apertures 20 are also formed in respective sides of each of upper and lower cover members 15 and 16. Each of right and left cover members 17 and 18 is provided with a groove 21 into which each projection 19 is inserted and two through-apertures 23 into each of which a screw 22 is inserted for the purpose of tightening each projection 19. Each of cover members 17 and 18 is also provided with an engagement opening 20 into which projection 24 is inserted. Projections 24 are engaged with engagement openings 20 and screws 22 inserted through apertures 23 are threadably engaged with U-shaped grooves 19*a* of coupling projections 19 inserted from grooves 21, respectively, whereby cover members 15, 16, 17 and 18 are coupled. Cover 14 is mounted on cabinet 1 by threadably engaging screws 22 with respective apertures 25 formed in the front side of compartment 2. Upper and lower cover members 15 and 16 have respective slit-shaped vent holes 15*a* and 16*a* for ventilating the interior of compartment 2 with drive of a fan provided for cooling the magnetron of high frequency heating apparatus 3. Members 14*a* are provided for concealing heads of screws 22 from view, respectively.

Figure 3:
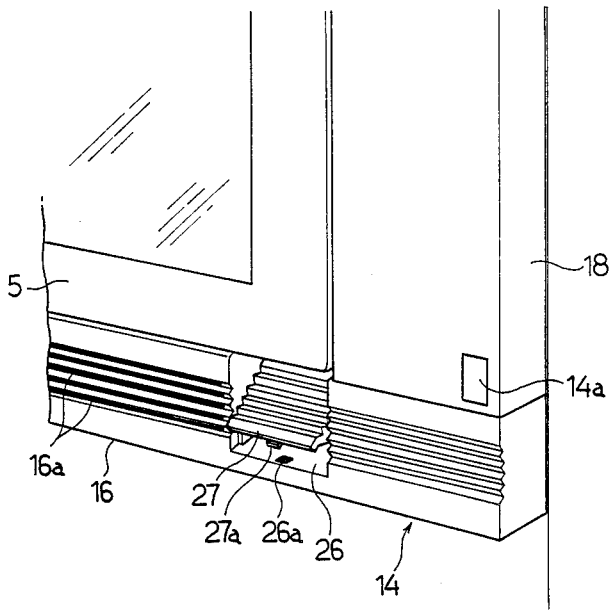
FIG. 3 is a perspective view of part of the cabinet relating to the invention.
Figure 4:
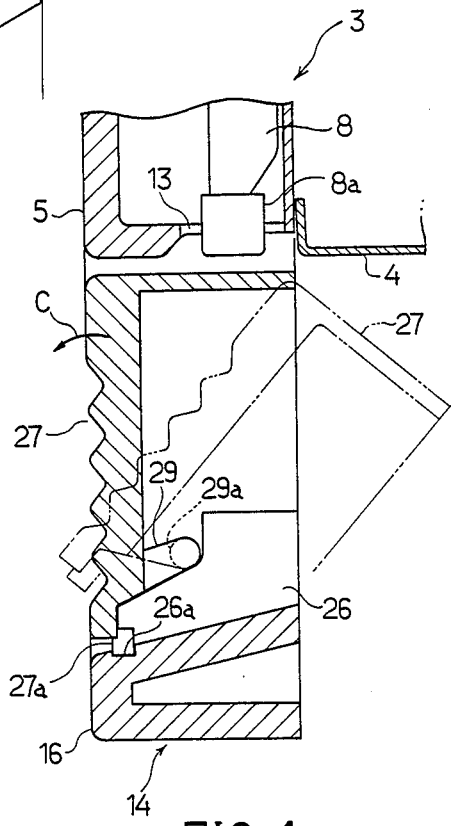
FIG. 4 is an enlarged longitudinal section of part of the cabinet relating to the invention.
Figure 5:
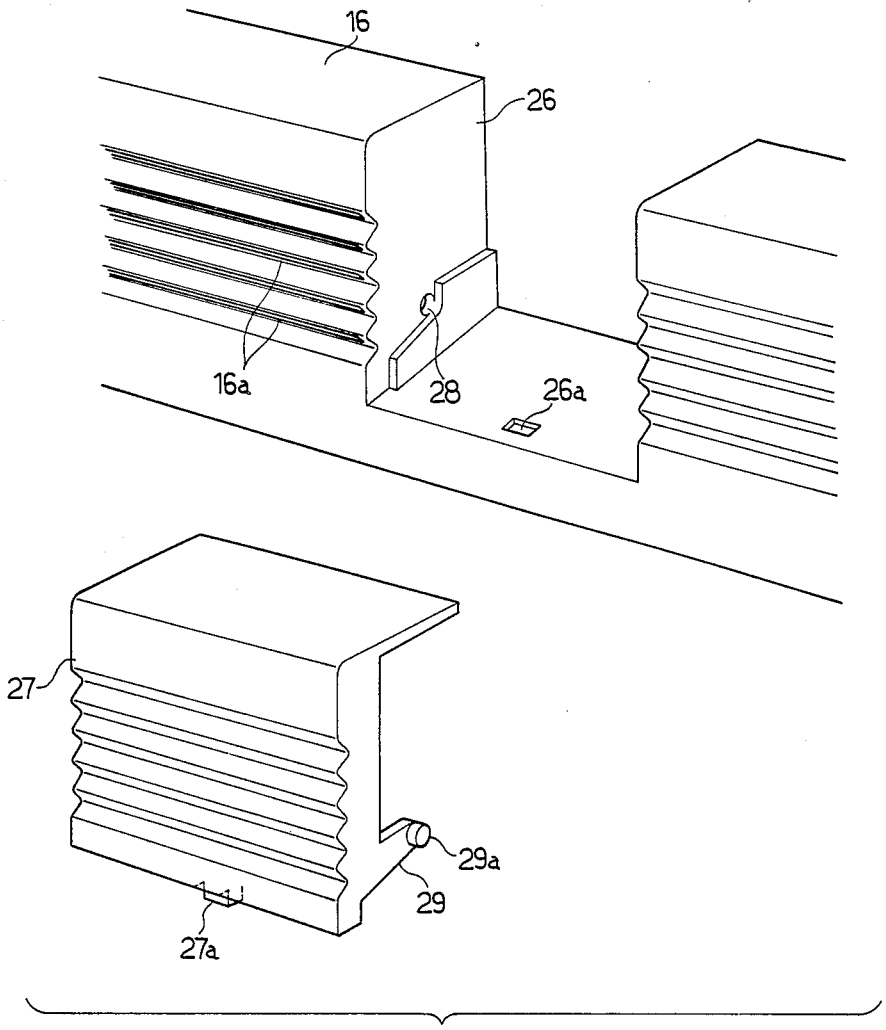
FIG. 5 is a partially enlarged exploded perspective view of part of the cabinet relating to the invention.

Referring now to FIGS. 3–5, a generally rectangular cut-out or recessed portion 26 is formed in the portion of cover 14 corresponding to push button 8*a* of rod 8 of high frequency heating apparatus 3 or the right-hand portion of cover member 16 as viewed in FIG. 3. The bottom portion of cut-out portion 26 is slanted downwardly in the direction of the outer peripheral side of the cover 14. A small door 27 serving as a closure member is provided for closing recessed portion 26. More specifically, shaft support holes 28 are formed in right-hand and left-hand side walls of recessed portion 26, respectively, one of such shaft support holes 28 being shown in FIG. 5. Elastic arm portions 29 are integrally formed on lower portions of right-hand and left-hand sides of small door 27 respectively, one of such elastic arm portions 29 being shown in FIGS. 4 and 5. Each arm portion has a shaft portion 29*a* projected in the direction of the length of the small door 27. Shaft portions 29*a* are inserted into shaft support holes 28 with arm portions 29 elastically deformed, whereby small door 27 is rotatably disposed in recessed portion 26. Small door 27 is rotatably moved to thereby close and open recessed portion 26. The positions of shaft portions 29 are deviated from the center of gravity of small door 27 to such a degree that the gravity moment causes a force to act on small door 27 so that the same is rotatably moved in the direction of arrow C in FIG. 4 or so as to forwardly fall down. The small door 27 usually closes recessed portion 26 owing to the force acting thereon so that the same is moved in the direction of arrow C. The bottom of recessed portion 26 is downwardly slanted in the direction of the front side thereof as described above and an engagement portion or stopper hole 26*a* is formed in the front bottom thereof. An engagement claw 27*a* integrally formed on the underside of small door 27 engages stopper hole 26*a* when small door 27 occupies the approximately vertical position.

Operation of cabinet 1 will be described. When door 5 of high frequency heating apparatus 3 is to be manually opened in the occurrence of the failure of electric power supply, small door 27 is backwardly pushed with a finger or the like so as to be rotatably moved in the direction opposite arrow C as shown by one long and two short dashes line in FIG. 4, thereby opening recessed portion 26. When push button 8*a* of rod 8 of high frequency heating apparatus 3 is then pushed upwardly with the finger inserted in recessed portion 26, both hooks 6 and 7 are rotatably moved in the direction opposite arrow A with upward movement of rod 8 to be disengaged from engagement openings 10, with the result that door 5 can be manually opened.

Although push button 8*a* is positioned at the lower front of high frequency heating apparatus 3 in the foregoing embodiment, push button 8*a* may be positioned at the upper front, right-hand or left-hand side of high frequency heating apparatus 3. In these cases, recessed portion 26 is formed in upper cover member 15, right-hand cover member 17 or left-hand cover member 18.

Furthermore, a spring member may be provided for usually urging small door 27 in the direction of the closed position thereof. Additionally, small door 27 may be temporally held in the open position shown in FIG. 4 by way of increasing a frictional force between shaft support holes 28 and respective shaft portions 29*a* and subsequently, the lower end of small door 27 may be pushed backward to the closed position.

As obvious form the foregoing, the manually operated member may be operated via the recessed portion formed in the cover when the closure member of the cover is opened. Consequently, the door of the cooking appliance may be opened without detaching the cover from the cabinet.

The foregoing disclosure and drawings are merely illustrative of the principles of the present invention and are not to be interpreted in a limiting sense. The only limitation is to be determined from the scope of the appended claims.

What I claim is:

1. A cabinet for a cooking appliance including a cooking chamber having a front opening, a door for closing the front opening of the cooking chamber, a locking mechanism for locking the door at a closed position, and a manually operated member provided in the vicinity of the front opening of the cooking appliance for manually unlocking the door locked by the locking mechanism, said cabinet comprising:

(a) a compartment for containing the cooking appliance;

(b) a cover provided for concealing a space between the front inner periphery of the compartment and the front outer periphery of the cooking appliance, the cover having a recessed portion formed therein so as to correspond to the manually operated member so that the manually operated member is positioned in said recessed portion, the recessed portion having a front opening; and (c) a closure member rotatably mounted on the cover so as to close and open the front opening of the recessed portion.

2. A cabinet according to claim 1, wherein the cooking appliance further includes a door opening switch and electromechanically door unlocking means operated by the door opening switch so as to unlock the door locked by the locking mechanism.

3. A cabinet according to claim 1, wherein the cooking appliance includes a high frequency heating apparatus.

4. A cabinet for a cooking appliance including a cooking chamber having a front opening, a door for closing the front opening of the cooking chamber, a locking mechanism for locking the door at a closed position, and a manually operated member provided in the vicinity of the front opening of the cooking appliance for manually unlocking the door locked by the locking mechanism, said cabinet comprising:

(a) a compartment for containing the cooking appliance;

(b) a cover provided for concealing a space between the front inner periphery of the compartment and the front outer periphery of the cooking appliance, the cover having a recessed portion formed therein so as to be caved in from the inner peripheral side to the outer peripheral side and so as to correspond to the manually operated member so that the manually operated member is positioned so as to face the interior of the recessed portion, the recessed portion having a front opening; and (c) a closure member having two shafts so as to be rotatably coupled to opposite walls of the recessed portion of the cover, thereby closing and opening the front opening of the recessed portion.

5. A cabinet according to claim 4, wherein the positions of the shafts of the closure member are deviated from the center of gravity of the closure member to such a degree that a gravity moment acts on the closure member in the recessed portion in the direction that the recessed portion is closed by the closure member.

6. A cabinet according to claim 4, wherein the recessed portion has an engagement portion in the bottom and the lower end of the closure member is engaged with the engagement portion when the closure member is moved from the approximately vertical position thereof so as to fall down forwardly, thereby preventing the closure member from falling down forwardly.

* * * * *